US006135922A

United States Patent [19]

Nissen

[11] Patent Number: 6,135,922

[45] Date of Patent: Oct. 24, 2000

[54] TRAMPOLINE ATTACHMENT

[76] Inventor: George Nissen, 5123 D Renaissance Ave., San Diego, Calif. 92122

[21] Appl. No.: 09/345,084

[22] Filed: Jun. 30, 1999

[51] Int. Cl.[7] ..... A63B 5/11

[52] U.S. Cl. ..... 482/27; 482/28

[58] Field of Search ..... 482/27, 28, 29, 482/77, 35; 446/220, 221; 441/40; 5/449, 455; 160/135; 256/73, 5–11

[56] References Cited

U.S. PATENT DOCUMENTS

| | | | |
|---|---|---|---|
| 3,201,123 | 8/1965 | Nissen | 482/29 |
| 4,478,420 | 10/1984 | Sowards | 482/29 |
| 5,711,743 | 1/1998 | Nichols, Jr. et al. | 482/27 |
| 5,941,798 | 8/1999 | Coan et al. | 482/28 |
| 6,053,845 | 4/2000 | Publicover et al. | 482/35 |

OTHER PUBLICATIONS

JumpSport™Home page, *Trampline Court*™, 1 page, dated Dec. 15, 1997.

JumpSport™brochure on the *Trampoline Court*™Safety Enclosure System, 2 pages, not dated. *

*Ultimate Basketball Experience,* Spaceball, Ltd., 6914 Rockingham Dr., SW, Cedar Rapds, IA, 52404, 1 page, ©JumpShot 1997.

Spaceball© color brochure, 2 pages, not dated. *

Spaceball© illustration by Echo Fox, Patent Applied for—1981.

Brochure on Spaceball, *Spaceball is played everywhere . . . ,* 1 page, not dated *

Brochure on *General Rules and Spaceball Scoring . . . ,* Nissen Corporation, 930 27th Avenue, S.W., Cedar Rapids, Iowa, not dated. *

Brochure on Spaceball, *Spaceball is played everywhere ...,* 1 page, not dated.

Brochure on *General Rules and Spaceball Scoring...,* Nissen Corporation, 930 27th Avenue, S.W., Cedar Rapids, Iowa, not dated.

Advertising materials with illustrations on NISSEN SPACEBALL, 2 pages, not dated.

*Primary Examiner*—Stephen R. Crow
*Attorney, Agent, or Firm*—Steven G. Roeder

[57] ABSTRACT

An attachment for a circular trampoline includes four backstops that are attached to the base frame of the trampoline. Each backstop includes a backstop bed, which is attached to an arch-shaped backstop frame with a suspension system. Each backstop is mounted to the base frame and extends upwardly and outwardly from the base bed. An apex of each backstop is positioned over the base frame. With this configuration, the backstops surround the user within a court-like protected area and help to prevent the user from falling off of the trampoline. Additionally, four aprons can be attached to the base bed near its perimeter and to a respective backstop frame to prevent the user of the trampoline from stepping on or hitting the base springs and/or the base trampoline frame. The attachment converts a round trampoline bed into a functionally rectangular bed in appearance to the user and provides the same reference point benefits of a rectangular trampoline bed.

20 Claims, 3 Drawing Sheets

TRAMPOLINE ATTACHMENT

FIELD OF THE INVENTION

The present invention pertains to attachments for round trampolines of various sizes and uses. The attachments create a superstructure which can accept various additional attachments to form an enclosed, protected, court-like area on the trampoline which minimizes the exposure to injuries for the user, while at the same time providing additional opportunities for utilizing the trampoline for additional purposes and activities.

BACKGROUND OF THE INVENTION

Trampolines were originally designed in rectangular and round shapes. Rectangular trampolines were found to be more conducive to acrobatic and competitive use because they were more portable and practical for indoor institutional use and gave better orientation for the users. Round trampolines were generally not considered practical for indoor use because of space and portability limitations, as well as the lack of reference points for the users to orient themselves. However, in recent years with the explosive craze for the outdoor home and backyard trampoline, these limitations are being overlooked because of the sheer joy and fun in trampolining.

With the great increase in sales and popularity of the home and backyard recreational round trampolines, which number in the hundreds of thousands of sales each year, there has been a corresponding increase in the number of injuries. Studies indicate that up to 80% of injuries result from a fall off of the trampoline due to loss of orientation and/or control. The use of this invention will help to minimize the exposure to injuries caused by falls off of a trampoline, as well as injuries caused by stepping between the trampoline bed and the trampoline frame, without sacrificing any of the many benefits derived from participating in trampolining, including aerobic exercise, strength, balance, agility, coordination, timing, rhythm and fun.

Round trampolines tend to cause a participant to lose orientation because there are no reference points for the user to ascertain his bearings, as there are when using a rectangular trampoline. The present invention converts a round trampoline bed into a functionally rectangular bed, as seen by the user, and provides the same reference point benefits of a rectangular trampoline bed.

With the present invention, the court-like area can be further divided into two courts with the addition of a gantry which bisects the trampoline bed. This dual court configuration allows additional activity and games such as spaceball.

With the above in mind, it is an object of the present invention to provide an attachment for a round trampoline: (i) which reduces the risk of injury to the user of the trampoline; (ii) which inhibits the user from failing in the gap between the trampoline bed and the trampoline frame and/or off of the trampoline; (iii) which allows for the playing of sports and games such as spaceball; (iv) which can be adapted to fit different sizes of circular trampolines; (v) which has an aesthetically pleasing appearance that is simplistic in design and compatible with the base round trampoline; (vi) which is easy to assemble, relatively simple and economical to manufacture using most of the same components as a round trampoline; and (vii) which forms a simple truss-like framework that is a uniquely sturdy superstructure requiring no other braces or attachments.

SUMMARY

A trampoline attachment in accordance with the present invention is used with a round trampoline having a base frame and a base bed that is attached to the frame with a suspension system. This attachment includes four backstop frames. Each backstop frame is arch-shaped, and includes an apex and two ends which are attaches to the base frame. Importantly, the attachment converts a round trampoline into a functionally rectangular enclosure and provides reference points for the user of the trampoline.

For each backstop frame, the ends are attached to the base frame with the apex projecting upwardly and radially outwardly from its ends. The four backstop frames are also mounted on the base frame so that each backstop frame overlaps two adjacent backstop frames. The adjacent backstop frames are fixed to each other at these overlap points.

Each backstop frame is described as being a semi-circular arch which is preferably approximately the same length as half the perimeter of the base trampoline frame. The ends of the backstop frames are then "squeezed" together so that when attached to the base frame, they are spaced less than one-half the diameter of the base frame. Stated another way, the length of each arch is equal to approximately one-half of the perimeter of the base trampoline, but the ends are spaced closer together when attached. This is true for all sizes of round trampolines that use this invention. This gives: (i) a desired relative increase in height of an apex for each arch; (ii) a desired preload effect to each arch; and (iii) a desired point of intersection of the arches for maximum strength and rigidity.

In the preferred embodiment of the invention, each apex for each backstop frame is spaced equally apart from two other apexes, and each backstop frame apex is located vertically above the base frame. With this configuration, the four backstop frames cooperate to form a sturdy and substantially rigid structure above the base frame.

The attachment of the present invention can also include one to four backstop beds. Each backstop bed can be secured to one backstop frame with a backstop suspension system. This positions each backstop bed across a portion of the trampoline working area, or the area of the base bed which is being jumped on. With this configuration, the backstop beds limit the trampoline user to a defined rectangular area on the base bed. Stated differently, the addition of the backstop beds to the backstop frames reconfigures the working area of he trampoline bed from a circular configuration to a rectangular-shaped Configuration. The rectangular-shaped working area helps the user remain oriented on the trampoline. Further, the backstops prevent the user from falling off of the trampoline.

The trampoline attachment preferably includes one to four aprons to additionally prevent injury to the user. Each apron has a lower end that attaches to a portion of the base bed at the perimeter. An upper corner of each side of the apron is attached in tension to the corresponding side of one of the backstop frames at a point a little higher than the width of the apron above the end of the backstop frame. Each apron is attached to a respective backstop in this manner. With this configuration, the aprons inhibit the user from stepping on or hitting the springs and/or the frame.

The present invention can also include two arch-shaped center frames for playing the game of spaceball. Two center nettings are also included, and both center nettings are formed with an opening and attached to each center frame with a suspension system. Wish this configuration, the center frames are mounted on the base frame to bisect the trampoline bed and project vertically upwards from the base frame. Next, the openings in the netting are connected to each other to establish a chute. This configures the trampoline for the game of spaceball. Because of the four backstops and the four aprons that are mounted to the trampoline, the trampoline is configured to play the game of spaceball with an increased measure of safety.

An alternative embodiment of the present invention applies to a much smaller round base trampoline (about one-half the diameter of the full sized recreation round trampolines—which are generally about fourteen feet in diameter) and includes one or more spotting rings. The spotting rings are centered over the working area of the base trampoline bed. Each ring is attached to the backstop frames with a plurality of resilient members. One end of each resilient member is attached to the spotting ring and the other end is attached to one of the back top frames. The resilient members suspend the spotting rings above the base bed of the trampoline. In this manner, the trampoline is configured to provide an added measure of safety and control in providing opportunities for special aerobic and conditioning exercises where the user can conveniently grip a spotting ring with one or both hands for added stability and control when jumping, bouncing, or running in place while confined within a spotting ring.

The purpose of this alternative Embodiment of the invention is to form a smaller protective area—just large enough for one user to be able to perform all the basic trampoline activities, but too confined for the user to be able to, or have the desire to, attempt any somersaulting (inversion) maneuvers. In other words, further reducing the user's exposure to two additional types of possible injury. Twenty percent of the injuries historically are not connected with falling off the trampoline, but rather hitting another user and/or landing incorrectly on the head or neck when attempting somersaulting maneuvers.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
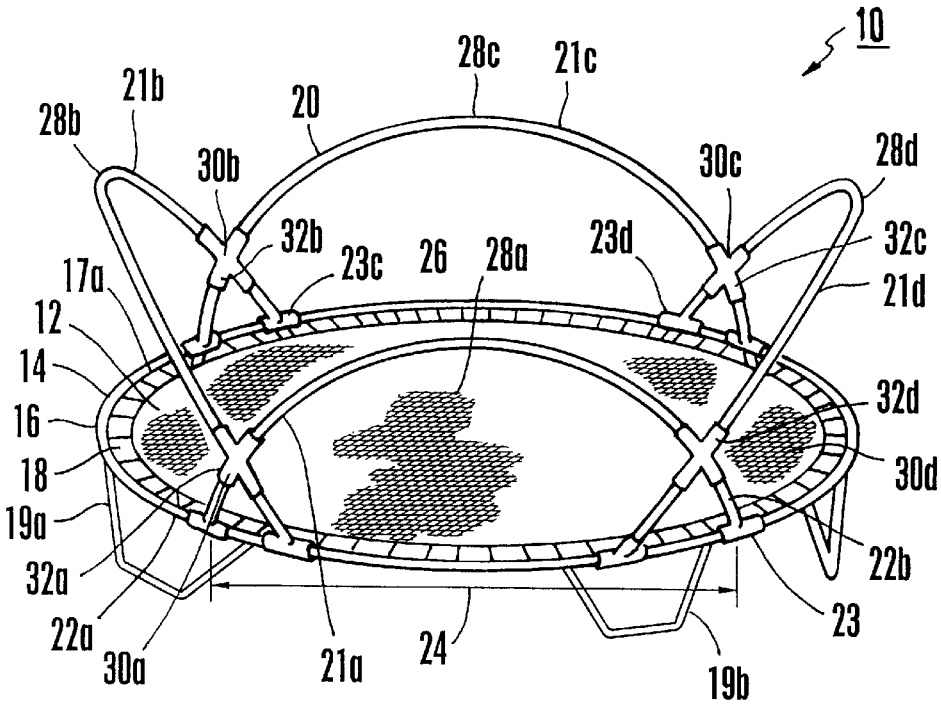
FIG. 1 is a drawing of a circular trampoline, which shows the four backstop frames of the attachment mounted on the base frame of the trampoline.

Referring initially to FIG. 1, the improved trampoline of the present invention is shown and generally designated 10. As shown in FIG. 1, a base bed 12 is attached to a base frame 14 with a suspension system 16. Typically, the suspension system 16 consists of a plurality of resilient members 17, of which member 17*a* is representative. This attachment of the base bed 12 to the base frame 14 places the base bed 12 in tension and forms an annular gap 18 between the base bed 12 and the base frame 14. As shown in FIG. 1, the base frame 14 is mounted on a plurality of arch-shaped legs 19, of which legs 19*a*, 19*b* are representative. Importantly, the base frame 14 and base bed 12 are circular, and the trampoline attachment 20 is intended to accommodate the circular trampoline 10.

The attachment 20 includes four substantially arch-shaped backstop frames 21*a–d*. Each backstop frame 21*a–d* includes a pair of spaced apart ends 22*a*, 22*b*. Preferably, the end; 22*a*, 22*b* are spaced apart an end distance 24 that is less than the diameter of the circular base frame 14. The backstop frames 21*a–d* for the attachment 20 are mounted on the base frame 14, with a plurality of brackets 23, of which brackets 23*c*, 23*d* are representative. Specifically, the back,top frames 21*a–d* are mounted on the base frame 14 to project vertically upwards from the base frame 14. Further, each backstop frame 21*a–d* projects sightly outward radially from the center 26 of the base bed 12, so that an apex 28*a–d* of each frame 21*a–d* is substantially directly above the base frame 14, as shown in FIG. 1.

The backstop frames 21*a–d* are also attached to each other. Specifically, each backstop frame 21*a–d* overlaps two other backstop frames 21*a–d* to establish four overlap points 30*a–d*, as shown in FIG. 1. At each overlap point 30*a–d*, the overlapping frames 21*a–d* are secured with a faceplate 32*a–d*. For example, consider backstop frame 21*a*. Backstop frame 21*a* is overlapped by backstop frames 21*b* and 21*d* at two overlap points 30*a*, 30*d*, as shown in FIG. 1. At these overlap points 30*a*, 30*d*, the backstop 21*a* is attached to backstops 21*b* and 21*d* with a pair of faceplates 32*a*, 32*d*. Similarly, the other backstop frames 21*b–d* are attached at the four overlap points 30*a–d*. With this configuration, a uniquely sturdy structure is formed by the attachment 20 of the present invention.

Figure 2:
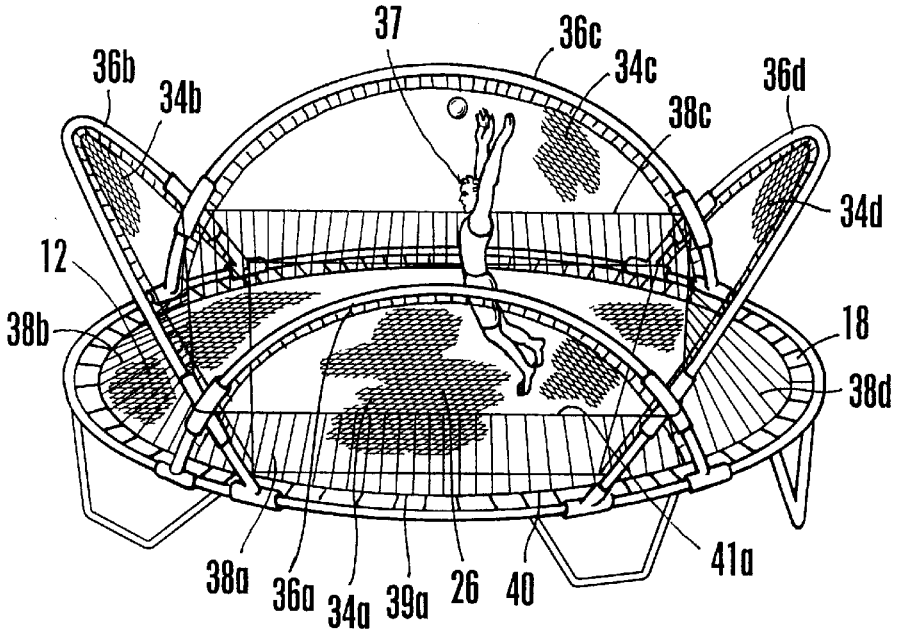
FIG. 2 is a drawing of the attachment, with a backstop bed attached to each backstop frame with a suspension system, and with an apron attached to a portion of the base bed and to a respective backstop frame.

Referring now to FIG. 2, the attachment 20 of the present invention can also include four backstop beds 34*a–d*. Each backstop bed 34*a–d* is attached to a backstop frame 21*a–d* with a backstop suspension system 36*a–d*. With this configuration, a trampoline-like effect is created in each of the backstop beds 34. If the trampoline user 37 rebounds against any of the backstop beds 34, the bed 34 reacts against the user 37 and directs the user 37 back towards the center 26 of the base bed 12. In the preferred embodiment, one of the backstop beds, bed 34*a*, for example, is omitted or made from a see-through netting material to allow for better spectator vision, coaching, and supervision.

The attachment 20 can also include four aprons 38*a–d* that are preferably made of a canvas material or of the same material as the base trampoline bed 12. These aprons 33*a–d* further prevent the user 37 from stepping on or falling into the annular gap 18 between the base bed 12 and the base frame 14. To do this, each apron 38*a–d* is attached to the base bed 12 and one of the backstop frames 21*a–d*. For example, apron designated 38*a* has a bottom end 39*a* that is attached to the base bed 12, near a perimeter 40 of the base bed 12. Apron 38*a* also has a top end 41*a* that is attached to backstop frame 21*a* by an elastic member. Aprons 38*b–d* have the same structure and are fixed to the base bed 12 and the backstop frames 21*b–d* in the same manner. With this Configuration, the user 37 is prevented from stepping on or falling between the base frame 14 and base bed 12.

Figure 3:
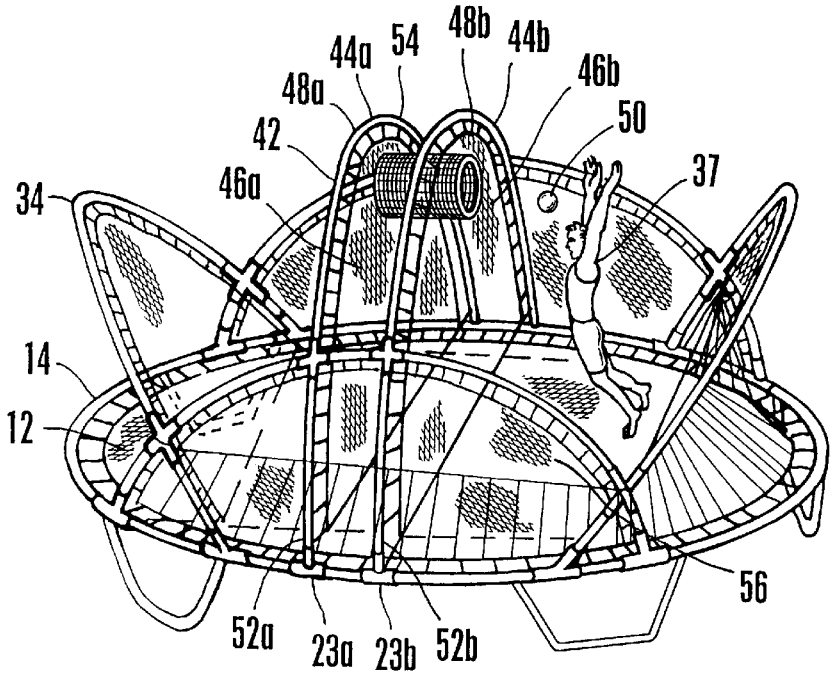
FIG. 3 is a drawing of the trampoline and the attachment of the present invention, with a center gantry included to configure the trampoline for the game of spaceball.

Referring now to FIG. 3, a center gantry 42 can be included with the trampoline 10 for configuring the trampoline 10 for the game of spaceball. The center gantry 42 has two substantially arch-shaped center frames 44*a,b* spaced about two feet apart and two center nettings 46*a,b* that are formed with openings 48*a,b* for passing a spaceball 50 through. The center netting 46*a* is attached to the center frame 44*a* with a center suspension system 52*a*. Similarly, center netting 46*b* is attached to center frame 44*b* with center suspension system 52*b*.

As shown in FIG. 3, the center frames 44 are mounted on the base frame 14 with brackets 23*a*, 23*b* (Brackets 23*c* and 23*d* are omitted from FIG. 3 for clarity). These center frames 44*a*, 44*b* project substantially perpendicularly from the base frame 14, and the openings 48*a*, 48*b* of the center frames 44 are connected with fabric to establish a chute 54. With this configuration, the trampoline 10 of the present invention is configured for the game of spaceball.

Importantly, the mounting of the backstops 21*a–d* to the circular base frame 14 establishes a rectangular Shaped working area 56 (illustrated in dashed lines in FIG. 3) on the base bed 12. This rectangular shaped working area 56 helps to orient the user 37 of the trampoline 10, and substantially minimizes the risk of the user 37 falling completely off of the trampoline 10. Additionally, the user 37 can rebound off of the backstops 21*a–d* to enhance the games played on the trampoline 10, because of the trampoline-like effect of the backstop beds 34 that is described above.

Figure 4:
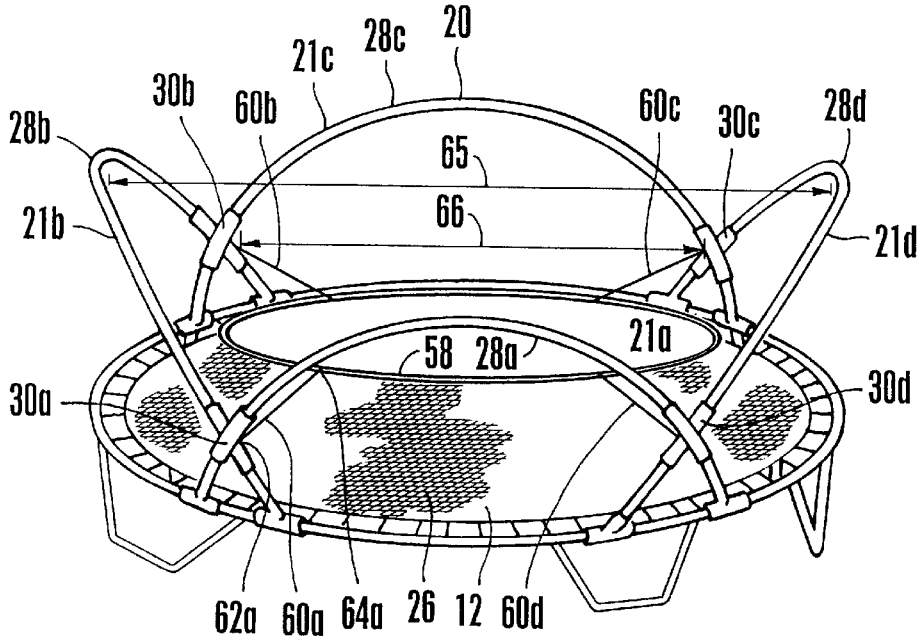
FIG. 4 is a drawing of the attachment of the present invention with a spotting ring attached to the backstop frames.

Referring now to FIG. 4, an alternative embodiment of the attachment is shown. In FIG. 4 a spotting ring 58 is suspended above the center 26 of the base bed 12 by a plurality of resilient members 60*a–*60*d*. Each resilient member 60*a–*60*d* connects the spotting ring 58 to one of the backstops 21*a–d*. For example, one end 62*a* of resilient member 60*a* is attached to the backstop frames 21*a*, near an overlap point 30*a* or to some point between overlap point 30*a* and the apex 28*a* of the arch-shaped frame 21*a*. The other end 64 of resilient member 60*a* is attached to the spotting ring 58. Resilient members 60*b–d* are attached to the backstop frames 21*b–d* and to the spotting ring 58 in the same manner. In the preferred embodiment of the invention, four resilient members 60*a–d* are attached to a respective overlap point 30*a–d* or some point between a respective overlap point 30*a–d* and apex 28*a–d* of the arch-shaped frames 21*a–d* and to the spotting ring 58, as shown in FIG. 4. With this configuration, the attachment 20 is configured to provide an added measure of safety, security and control to the user (not shown in FIG. 4) while the user is running, jumping, and doing aerobic fitness exercises on the trampoline 10. Importantly, this embodiment of the attachment 20 is intended for use with a single-user trampoline 10. Accordingly, for this alternative embodiment of the invention, the base frame 14 for the trampoline 10 preferably has a diameter 65 of approximately six to eight feet. Further, the spotting ring 58 preferably has a diameter 66 of approximately five to seven feet.

Figure 5:
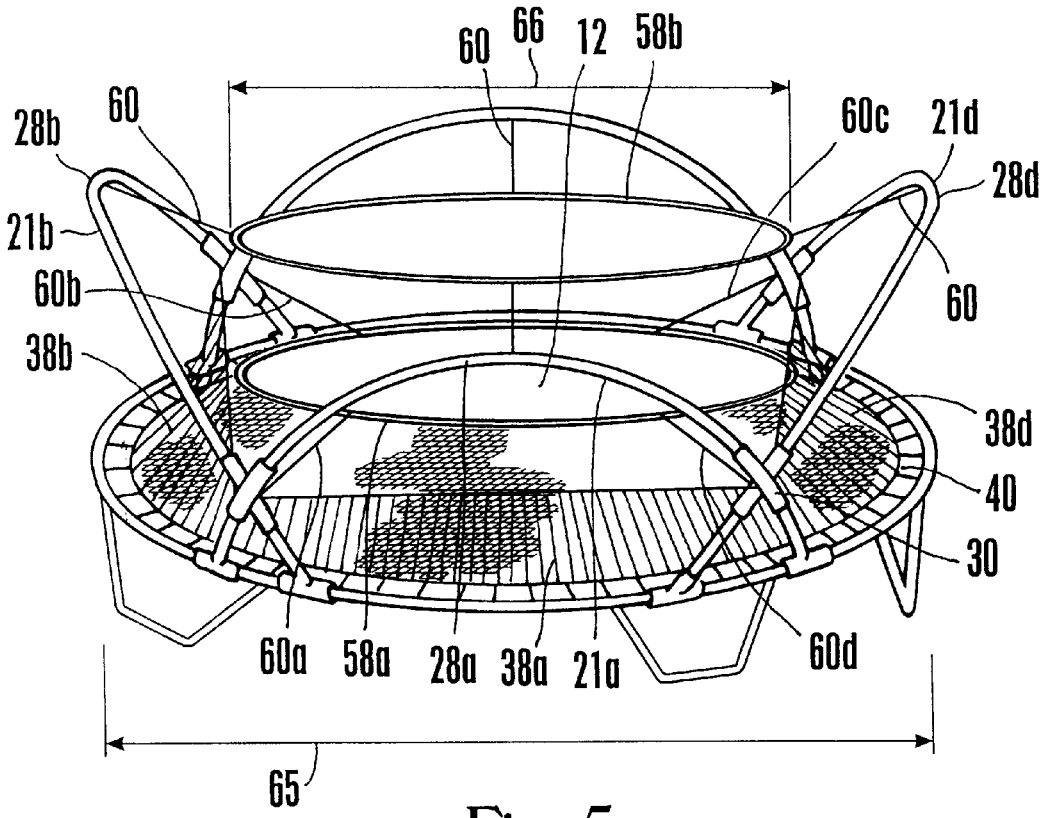
FIG. 5 is drawing of an alternative embodiment of the attachment of the present invention, with two spotting rings attached to the backstop frames.

FIG. 5 illustrates another, alternative embodiment of the attachment 20. This embodiment is particularly useful for a trampoline 10 with a diameter 65 of about six to eight feet, or for the same type of trampoline for use by a single user (not shown in FIG. 5) as discussed above. In this embodiment of the invention, at least two spotting rings 58*a*, 58*b* are attached to the arch-shaped frames 21*a–d*. The bottom spotting ring 58*a* is attached to the frames 21*a–d* with resilient members 60*a–d* in the same manner as described above, near the overlap point 30 of two adjacent backstop frames 21*a–d*. The top spotting ring 58*b*, however, is attached to the frames 21*a–d* by attaching the resilient members 60 near the apexes 28*a–d* of each frame 21*a–d*.

As illustrated in FIG. 5, the aprons 38*a,b,d* (Apron 38*c* is not shown in FIG. 5) are attached to the perimeter 40 of the trampoline bed 12, and to the backstop frames 21*a–d*, also as described above. With this configuration, the working area 56 of the trampoline 10 is just large enough for one user to be able to perform all the basic activities in the trampoline 10, but too confined for more than one user, or for the user to be able to attempt any somersaulting (inversion) maneuvers. At the same time, the single user can conveniently grip a spotting ring 58*a,b* for added stability and control when jumping bouncing, or running in place awhile confined within the spotting rings 58*a,b*. For this purpose, the spotting rings 58*a*, 58*b* preferably have a diameter 66 of approximately five to seven feet.

While the particular Improved Trampoline as herein shown and disclosed in detail is fully capable of obtaining the objects and providing the advantages herein before stated, it is to be understood that it is merely illustrative of some of the presently preferred embodiments of the invention and that no limitations are intended to the details of construction or design herein shown other than as described in the appended claims.

What is claimed is:

1. An attachment for a round trampoline, the trampoline including a base frame having a perimeter, a base bed and a suspension system securing the base bed to the base frame, the attachment comprising:

four, arch-shaped, backstop frames which are adapted to be mounted to the base frame with (i) an apex of each backstop frame positioned above the base frame, (ii) the apex of each backstop frame spaced apart from the apex of each of the other backstop frames, and (iii) each backstop frame partly overlapping and being connected to two of the other backstop frames, (iv) the perimeter of each backstop frame being approximately equal in length to one-half of the perimeter of the base frame; wherein the backstop frames, when attached to the base frame, cooperate to form a sturdy and substantially rigid structure above the base frame;

wherein each backstop frame includes a pair of frame ends are spaced apart a distance which is less than the diameter of the base frame and wherein the frames ends are adapted to be secured to the base frame;

wherein the apex of each backstop is positioned upward and radially outward from the frame ends of each backstop frame and the apex of each backstop frame is positioned approximately vertically above the base frame; and wherein the apexes of the backstop frames are spaced approximately equally apart.

2. The attachment of claim 1 further comprising four aprons, each apron having a first end being adapted to attach to the base bed near a perimeter of the base bed and a second end being adapted to attach to one of the backstop frames.

3. The attachment of claim 2 further comprising at least two backstop beds and at least two backstop suspension systems, each backstop suspension system attaching one of the backstop beds to one of the backstop frames.

4. The attachment of claim 3 further comprising (i) two arch-shaped center frames, the center frames being adapted to mount to the base frame to bisect the base bed, and (ii) two nettings, each netting extending across one of the center frames.

5. The attachment of claim 1 further comprising (i) at least one spotting ring and (ii) at least one resilient member which extends between the at least one spotting ring and at leas, two of the backstop frames to suspend the at least one spotting ring above the base bed of the trampoline.

6. The attachment of claim 2 further comprising (i) at least one spotting ring and (ii) at least one resilient member which extends between the at least one spotting ring and at least two of the backstop frames to suspend the at least one spotting ring above the base bed of the trampoline.

7. An attachment for a round trampoline, the trampoline including a base frame having a perimeter, a base bed and a suspension system securing the base bed to the base frame, the attachment comprising:

four, arch-shaped, backstop frames which are adapted to be mounted to the base frame with (i) an apex of each backstop frame positioned above the base frame, (ii) the apex of each backstop frame spaced apart from the apex of each of the other backstop frames, and (iii) each backstop frame partly overlapping and being connected to two of the other backstop frames, (iv) the perimeter of each backstop frame being approximately equal in length to one-half of the perimeter of the base frame; wherein the backstop frames, when attached to the base frame, cooperate to form a sturdy and substantially rigid structure above the base frame.

8. The attachment of claim 7 wherein each backstop frame includes a pair of frame ends are spaced apart a distance which is less than the diameter of the base frame and wherein the frame ends are adapted to be secured to the base frame.

9. The attachment of claim 8 wherein the apex of each backstop is positioned upward and radially outward from the frame ends of each backstop frame and the apex of each backstop frame is positioned approximately vertically above the base frame.

10. The attachment of claim 8 further comprising at least two backstop beds and at least two back stop suspension systems, each backstop suspension system attaching one of the backstop beds to one of the backstop frames.

11. The attachment of claim 7 wherein the apexes of the backstop frames are spaced approximately equally apart.

12. The attachment of claim 7 further comprising four aprons, each apron having a first end being adapted to attach to the base bed near a perimeter of the base bed and a second end being adapted to attach to one of the backstop frames.

13. The attachment of claim 9 further comprising (i) two arch-shaped center frames, the center frames being adapted to mount to the base frame to bisect the base bed, and (ii) two nettings, each netting extending across one of the center frames.

14. The attachment of claim 7 further comprising (i) at least one spotting ring and (ii) at least one resilient member which extends between the at least one spotting ring and at least two of the backstop frames to suspend the at least one spotting ring above the base bed of the trampoline.

15. A combination comprising:

a trampoline including an annular shaped base frame having a perimeter, a base bed and a suspension system securing the base bed to the base frame; and an attachment including four, arch-shaped, backstop frames which are mounted to the base frame with (i) an apex of each backstop frame positioned above the base frame, (ii) the apex of each backstop frame spaced apart from the apex of each of the other backstop frames, and (iii) each backstop frame partly overlapping and being connected to two of the other backstop frames;

wherein the backstop frames cooperate to form a sturdy and substantially rigid structure above the base frame.

16. The combination of claim 15 wherein each backstop frame includes a pair of frame ends; wherein the frame ends are spaced apart an distance which is approximately equal to a diameter of the base frame prior to attachment to the base frame and wherein the frame ends are secured to the base frame.

17. The combination of claim 15 wherein the apex of each backstop is positioned upward and radially outward from the frame ends of each backstop frame and the apex of each backstop frame is positioned approximately vertically above the base frame.

18. The combination of claim 15 further comprising four backstop beds and four backstop suspension systems, each backstop suspension system attaching one of the backstop beds to one of the backstop frames.

19. The combination of claim 15 further comprising four aprons, each apron having a first end attached to the base bed near a perimeter of the base bed and a second end being adapted to attach to one of the backstop frames.

20. The combination of claim 15 further comprising (i) a spotting ring and (ii) a resilient member which extends between the spotting ring and at least one of the backstop frames to support the spotting ring above the base bed of the trampoline.

* * * * *